US005100108A

United States Patent [19]

Schultz

[11] Patent Number: 5,100,108

[45] Date of Patent: Mar. 31, 1992

[54] GUARD FENCE SYSTEM

[75] Inventor: Kevin R. Schultz, West Allis, Wis.

[73] Assignee: Figgie International, Inc., Willoughby, Ohio

[21] Appl. No.: 763,084

[22] Filed: Sep. 20, 1991

[51] Int. Cl.[5] ..... E04H 17/16

[52] U.S. Cl. ..... 256/24; 256/23; 256/73; 52/239

[58] Field of Search ..... 256/24, 25, DIG. 6, 256/23, 73; 52/239

[56] References Cited

U.S. PATENT DOCUMENTS

| | | | |
|---|---|---|---|
| 2,970,677 | 2/1961 | Springs, Jr. et al. | 52/483 |
| 3,037,593 | 6/1962 | Webster | 256/24 X |
| 3,194,361 | 7/1965 | Thurman | 52/239 X |
| 3,332,182 | 7/1967 | Mark | 256/24 X |
| 4,371,148 | 2/1983 | Harden | 256/25 X |

*Primary Examiner*—Andrew V. Kundrat
*Attorney, Agent, or Firm*—Paul R. Puerner

[57] ABSTRACT

A guard fence system is useful for preventing persons from falling off bleachers. The guard fence system comprises at least two upright posts mounted to the bleachers. Each post has a lower U-channel and an upper U-channel spaced a predetermined distance apart. The lower and upper U-channels have respective slots that open into the top ends of the U-channels. A guard fence member comprises a rectangular frame covered with a grill material. Upper and lower pins extend oppositely from the frame vertical members. The lower pins of the guard fence member are inserted into the slots of the lower U-channel. The guard fence member is pivoted to a generally vertical attitude such that the guard fence member upper pins are proximate the upper U-channels on the posts. The guard fence member is lifted and further pivoted until the upper pins thereof are vertically over the slots of the corresponding upper U-channels on the posts. Then the guard fence member is dropped so that the upper pins thereon enter the slots of the upper U-channels. The slots on the lower U-channels are sufficiently long to prevent the guard fence member lower pins from disengaging from the lower U-channels when the guard fence member is lifted. A bolt is removably inserted into at least one of the lower or upper U-channels to prevent unintentional lifting of the guard fence member out of the slots.

18 Claims, 2 Drawing Sheets

GUARD FENCE SYSTEM

BACKGROUND OF THE INVENTION

1. Field of the Invention

This invention pertains to safety equipment, and more particularly to fences.

2. Description of the Prior Art

Various types of railings and similar barriers have been developed to protect spectators from falling from bleachers and stands. With fixed stands, which are usually installed out of doors, it is a common practice to erect permanent guard railings around the ends and top of the stands, and also around stairwells. However, collapsible indoor bleachers present a more difficult problem. Permanent guard rails are not practical along the ends of the bleachers, as such guard rails would interfere with opening and closing the bleachers.

It is possible to adapt various assemblable and disassemblable structures such as scaffolds and the like for use as bleacher guard rails. For example, U.S. Pat. Nos. 4,140,414; 4,142,809; and 4,537,540 show various types of frames that are assemblable by means of headed connection members and cooperating slots. Other scaffold related connectors may be seen in U.S. Pat. Nos. 2,435,171; 2,588,905; 4,165,944; and 4,718,787. U.S. Pat. No. 4,413,366 shows a bed frame that includes locking pins and hooks for removably assembling side rails to the headboard and footboard.

Despite the wide variety of prior rail-like structural members and connections, for various reasons none is entirely suitable for use as a bleacher guard. One important reason is that the prior structures do not include grill-like components specifically intended to prevent persons from passing through them.

Thus, a need exists for practical bleacher guards.

SUMMARY OF THE INVENTION

In accordance with the present invention, a versatile guard fence system is provided that is specifically designed for use with portable bleachers. This is accomplished by apparatus that includes a guard fence member that is quickly and easily assembled to and that spans an entire area between two spaced support posts.

The support posts may be permanently mounted to the bleachers at any desired location such as on the ends of a section or along the back on the top section. Each post has two U-channels attached to it. A lower U-channel has a relatively deep open-top vertically oriented slot. An upper U-channel is spaced at a predetermined distance above the lower U-channel. The upper U-channel has a relatively short open-top vertically oriented slot. The upper U-channel has a hole through it parallel to the plane of the slot and above the bottom surface of the slot.

The guard fence member has a generally rectangular frame with a grill of woven wire or similar fence-like material covering the frame opening. The width of the frame is slightly less than the spacing between two support posts when the bleachers are in their installed position. Two pins extend laterally from each side of the frame. The two pins on each side of the frame are spaced apart a distance equal to the spacing between the slots in the lower and upper U-channels on the posts.

To use the guard fence system of the present invention, support posts are mounted at desired locations on the bleachers. A guard fence member is held in any non-vertical attitude between two posts. The pins at the lower end of the guard fence member frame are placed within the corresponding slots in the lower U-channels of the two posts. Then the guard fence member is rotated upwardly about the pivot point formed by the frame lower pins and the lower U-channels on the posts. When the guard fence member is almost vertical, the two upper pins thereon are proximate the corresponding two upper U-channels on the posts. The guard fence member is lifted a short distance until the upper pins thereon clear the top ends of the upper U-channel and can be aligned vertically over the slots in the two upper U-channels. The slots in the lower U-channels of the two posts are long enough so that the frame lower pins do not rise out of the lower U-channels when the guard fence member is lifted. Then the guard fence member is lowered such that the upper pins thereon enter the upper U-channel slots, and the guard fence member is sturdily in place on the post. To eliminate the possibility of unintentional disassembly of the guard fence member from the post, bolts are inserted through the holes in the upper U-channels above the associated pins. The bolts must be removed before the guard fence member can be lifted out of the U-channels.

As many guard fence members as desired can be installed along the bleachers to form a continuous fence-like guard. The ends posts of a series may have a single lower U-channel and upper U-channel. The posts intermediate the end posts have two sets of lower and upper U-channels that extend from opposite sides of the post. In that manner, one intermediate post supports the sides of two different guard fence members.

Other advantages, benefits, and features of the invention will become apparent to those skilled in the art upon reading the detailed description of the invention.

DETAILED DESCRIPTION OF THE INVENTION

Referring to FIGS. 1–6, a guard fence system 1 is illustrated that includes the present invention. The guard fence system is particularly useful for preventing persons from falling from stands and bleachers, but it will be understood that the invention is not limited to applications involving elevated structures.

Figure 1:
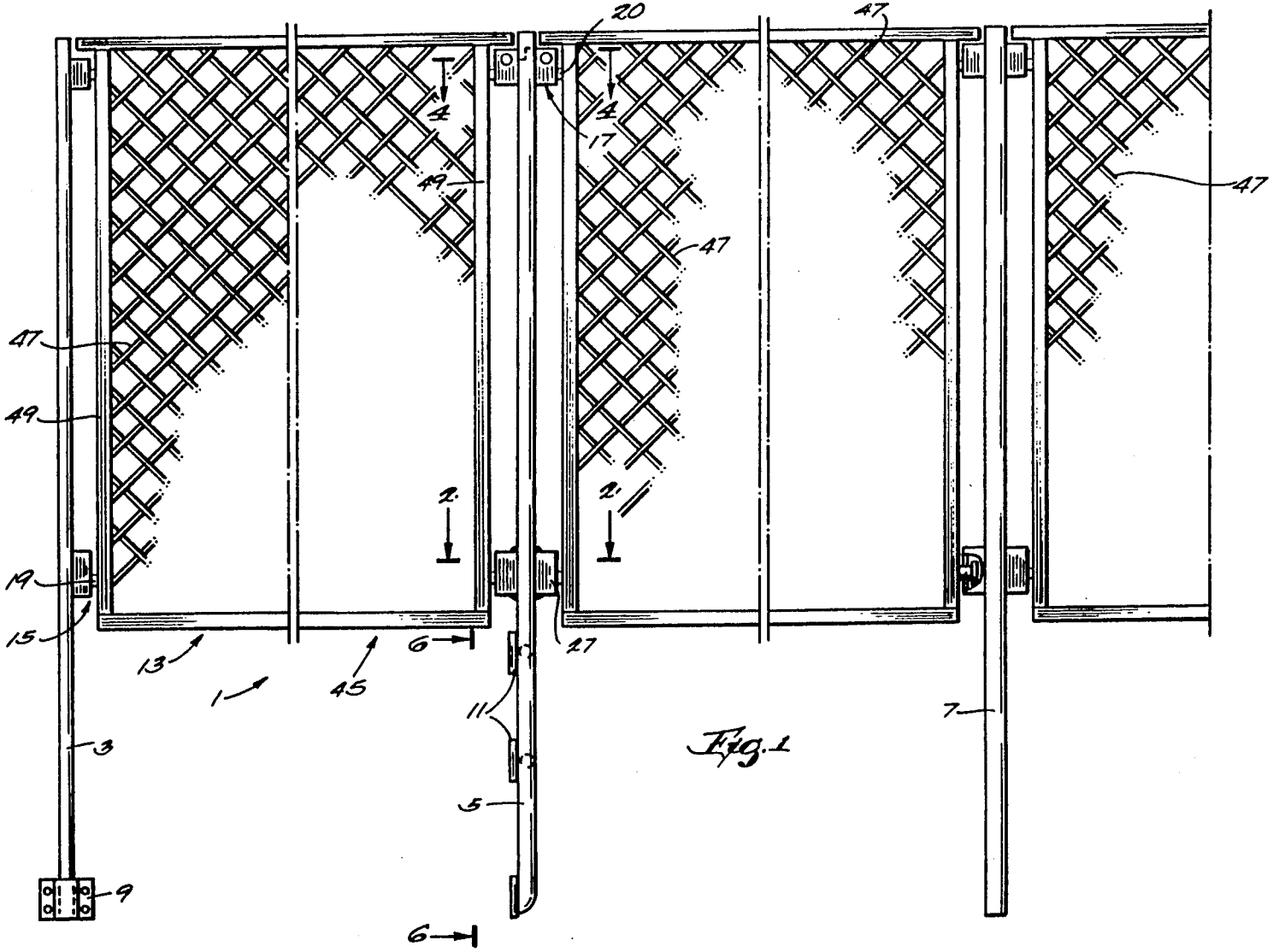
FIG. 1 is a front view of a typical portion of the guard fence system of the present invention.
Figure 6:
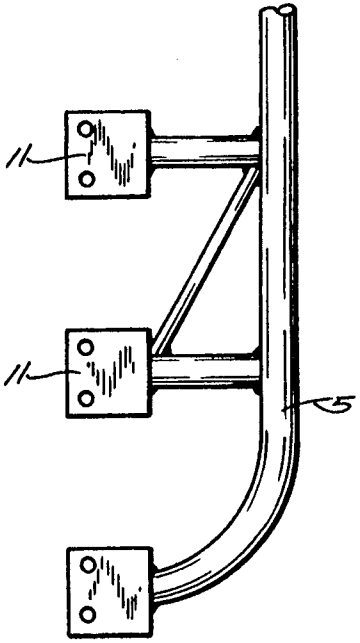
FIG. 6 is a view taken along line 6—6 of FIG. 1.

The guard fence system comprises a number of posts typically represented at reference numerals 3, 5, and 7. The guard fence system is very versatile, and the posts are designed to suit the specific application. The lower end of each post is mounted to the desired structural member, such as the end of a bleacher section, not shown. The particular structural member dictates the mounting design incorporated into the post. For example, the post may be straight for its entire length and have a single flat plate welded to the post lower end, such as is shown at post 3 and plate 9 of FIG. 1. Some applications may require a more elaborate mounting design, such as a curved post with several plates fixed to one or more short side bars. FIGS. 1 and 6 illustrate a representative design of a post 5 having two plates and side bar combinations 11. In all cases, the mounting of the posts 3, 5, and 7 to the bleachers or other structural members is intended to be permanent.

The guard fence system 1 further comprises a number of guard fence members 13 that, unlike the posts 3, 5, 7, are intended to be assembled to the posts on a temporary basis. Consequently, the guard fence members 13 are designed for quick and easy assembly to and disassembly from the posts. The guard fence members are identical in their basic construction, although they may vary in size to suit the specific application at hand.

Any number of posts and guard fence members 13 may be assembled into a single guard fence system 1. Each guard fence member of a system is assembled between two posts. For that purpose, each post has a lower U-channel 15 and an upper U-channel 17 welded or otherwise attached to the post. Looking especially at FIGS. 2 and 3, each lower U-channel 15 has a generally channel-shaped cross-section composed of a middle leg 23 and two side legs 21. The lower U-channel is preferably approximately 3.5 inches in overall length. The free ends of the channel side legs 21 are welded to the post. The middle leg 23 is formed with a vertically extending slot 25 that is open at the top end 27 of the U-channel. The slot 25 preferably extends for approximately 2.75 inches from the U-channel top end 27 and terminates in an arcuate bottom surface 28.

Figure 4:
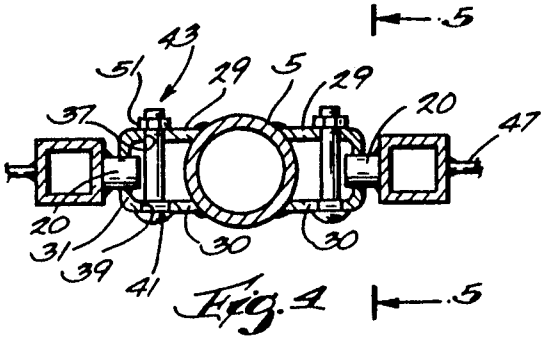
FIG. 4 is an enlarged cross-sectional view taken along line 4—4 of FIG. 1.
Figure 5:
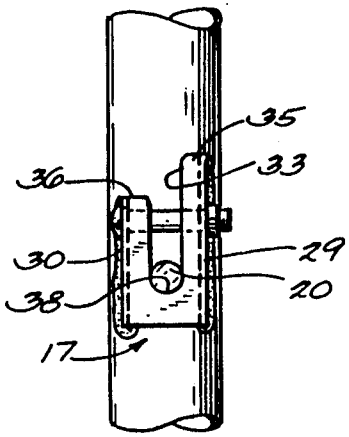
FIG. 5 is a cross-sectional view taken along line 5—5 of FIG. 4 and rotated 90° clockwise.
Figure 2:
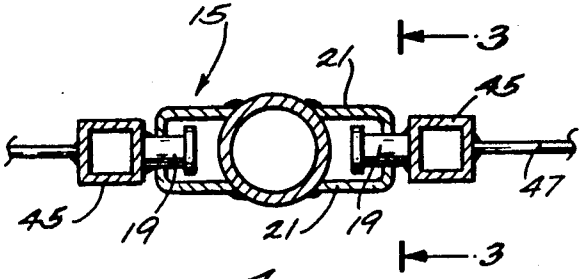
FIG. 2 is an enlarged cross-sectional view taken along lines 2—2 of FIG. 1.
Figure 3:
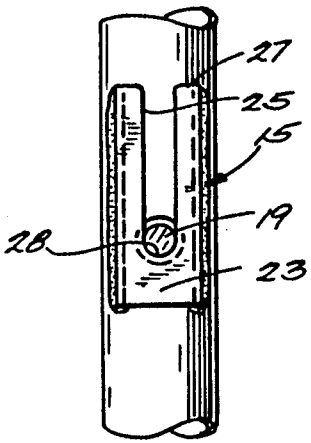
FIG. 3 is a cross-sectional view taken along lines 3—3 of FIG. 2 and rotated 90° clockwise.

The upper U-channels 17, FIGS. 4 and 5, are also fabricated as channel members having end legs 29 and 30 and a middle leg 31. The overall length of the upper U-channel is preferably approximately 2.75 inches. The free ends of the end legs 29 and 30 are welded to the post. The end leg 30 is approximately one inch shorter than the end leg 29 so that the top end 35 of the U-channel has a step 36. The upper U-channel has a slot 33 that opens from the top end 35 and the step 36. The depth of the slot 33 may be approximately 2 inches from the top end 35. A pair of concentric holes 37 and 39 are formed in the upper U-channel side legs 29 and 30, respectively, at a location between the upper U-channel step 36 and the bottom 38 of the slot 33. The hole 37 may be round, but I prefer that the hole 39 is square to accept the square portion 41 of the head of a carriage bolt 43.

Each guard fence member 13 is manufactured with a rectangular frame 45 of bar channels or similar structural components. The area between the frame 45 is filled with a grill 47, such as woven wire or chain links. Extending outwardly from each vertical structural component 49 of the frame near its lower end is a headed pin 19. Similar pins 20 extend outwardly from the upper ends of the respective vertical components 49. The vertical spacing between the pins 19 and 20 of each vertical component is substantially equal to the spacing between the bottom surfaces 28 and 38 of the slots 25 and 33 of the post lower U-channel and upper U-channel 15 and 17, respectively.

To assemble a guard fence member 13 between two posts, such as between posts 3 and 5, the guard fence member is held in any non-vertical attitude on the same side of the posts as the short legs 30 and steps 36 of the upper U-channel 17. The pins 19 at the lower end of the guard fence member are inserted into the slots 25 of the corresponding lower U-channels 15 until the pins rest on the slot bottom surfaces 28. Then the guard fence member is pivoted toward the vertical until the pins 20 at the upper end of the guard fence member are proximate the corresponding upper U-channel 17 on the posts. The guard fence member is lifted approximately 1.25 inches, which raised the pins 20 above the upper U-channel steps 36. The guard fence member can then be pivoted to the vertical orientation such that the pins 20 are vertically over the slots 33. The relatively long lengths of the lower U-channels 15 assure that the pins 19 remain in the lower U-channel slots 25 when the guard fence member is lifted. When the pins 20 are vertically over the slots 33 of the upper U-channel member, the guard fence member is lowered until both pins 19 rest on the bottom surfaces 28 of the respective lower U-channel slots 25 and the pins 20 simultaneously rest on the bottom surfaces 38 of the upper U-channel slots 33. A carriage bolt 43 is inserted through the holes 37 and 39 of each upper U-channel and is retained there with a nut 51. The guard fence system 1 is then securely in place, providing protection against a person falling from the bleacher area adjacent the system.

As mentioned, the guard fence system 1 is exceptionally versatile. A single guard fence member 13 may be used in conjunction with two posts, such as posts 3, each having a single lower U-channel 15 and upper U-channel 17. On the other hand, a guard fence system can contain several guard fence members and the corresponding posts. It is contemplated that a post with a single lower U-channel and upper U-channel, such as post 3, will be used at both ends of an installation, and the posts with double lower and upper U-channels will be used intermediate the end posts.

Thus, it is apparent that there has been provided, in accordance with the invention, a guard fence system that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A guard fence system comprising:

a. a first upstanding post having upper and lower ends, the post lower end being mounted to a selected member;

b. a first lower U-channel having a top end and being attached to the first post intermediate the upper and lower ends thereof, the first lower U-channel defining a vertically oriented slot that opens from the top end thereof;

c. a first upper U-channel having a top end and being attached to the post proximate the post upper end, the upper U-channel defining a vertically oriented slot that opens from the top end thereof;

d. a second upstanding post having upper and lower ends, the lower end being mounted to a selected member generally parallel to and at a predetermined distance from the first post;

e. a second lower U-channel having a top end and being attached to the second post intermediate the upper and lower ends thereof, the second lower U-channel defining a vertically oriented slot that opens from the top end thereof and that is in facing relation to the slot on the first lower U-channel;

f. a second upper U-channel having a top end and being attached to the second post proximate the second post upper end, the second upper U-channel defining a vertically oriented slot that opens from the top end thereof and that is in facing relation to the slot of the first upper U-channel; and g. a guard fence member having lower oppositely extending pins pivotally and slidingly received in the slots of the first and second lower U-channels and upper oppositely extending pins pivotally and slidingly received in the slots of the first and second upper U-channels, so that the guard fence member can be assembled to the first and second posts by dropping the pins into the slots of the associated U-channels and the guard fence member can be disassembled from the posts by lifting the guard fence member pins out of the slots of the lower and upper U-channels.

2. The guard fence system of claim 1 wherein a second lower U-channel is attached to the first post and extends oppositely from the first post as the first lower U-channel thereon, and wherein a second upper U-channel is attached to the first post and extends oppositely therefrom as the first upper U-channel.

3. The guard fence system of claim 1 wherein:

a. the slots in the lower U-channel and upper U-channel have respective bottom surfaces that are spaced a predetermined distance apart; and b. the upper and lower pins of the guard fence member are spaced the same distance apart as the bottom surfaces of the slots of the upper and lower U-channels, so that the guard fence member upper and lower pins are supported simultaneously by the bottom surfaces of the upper and lower U-channels, respectively.

4. The guard fence system of claim 1 wherein:

a. the upper U-channel is fabricated with a channel-shaped cross-section having first and second side legs and a middle leg, the middle leg defining the slot in the upper U-channel; and b. the second side leg of the upper U-channel is shorter than the first side leg to create a step in the top end of the upper U-channel.

5. The guard fence system of claim 3 wherein the slots in the lower U-channels are longer than the slots in the upper U-channels to thereby enable the guard fence member to be assembled to the first and second posts by inserting the guard fence member lower pins into the slots of the lower U-channels, pivoting the guard fence member within the lower U-channels until the guard fence member upper pins are proximate the respective upper U-channels of the first and second posts, and lifting and pivoting the guard fence member until the upper pins thereof are vertically over the slots of the corresponding upper U-channels without the guard fence member lower pins rising out of the slots of the lower U-channels.

6. The guard fence system of claim 1 further comprising bolt means removably inserted into a selected one of the lower and upper U-channels for preventing lifting of the guard fence member from the lower and upper U-channels and thereby prevent disassembly of the guard fence member from the first and second posts.

7. The guard fence system of claim 5 wherein the upper U-channels are formed with respective steps in the top ends thereof, and wherein the guard fence member is lifted and pivoted to pass the upper pins thereof above the steps of the corresponding upper U-channels to align the guard fence member upper pins vertically over the slots in the corresponding upper U-channels.

8. The guard fence system of claim 4 further comprising bolt means removably inserted through the first and second side legs of at least one of the first and second upper U-channels above the guard fence member upper pin that is received in the upper U-channel to thereby prevent the guard fence member from being lifted out of the sides of the lower and upper U-channels.

9. Apparatus for preventing a person from falling from bleachers or the like comprising:

a. a guard fence member comprising:

i. a rectangular frame having first and second spaced apart vertical members;

ii. first and second upper pins extending oppositely from the first and second vertical members, respectively;

iii. first and second lower pins extending oppositely from the first and second vertical members, respectively, and spaced at a predetermined distance from the respective upper pins; and iv. grill means joined to and filling the area between the frame;

b. first and second posts mounted to the bleachers or the like proximate the first and second vertical members of the guard fence member frame;

c. first and second lower U-channels attached to the respective first and second posts, each lower U-channel having a top end and a slot therein that opens into the top end and that removably receives a lower pin of the guard fence member; and d. first and second upper U-channels attached to respective first and second posts, each upper U-channel having a top end and a vertical slot therein that opens into the top end and that removably receives an upper pin of the guard fence member, so that the guard fence member pins can be inserted into the slots in the lower and upper U-channels to thereby assemble the guard fence member to the posts.

10. The apparatus of claim 9 wherein the slots of the first and second lower U-channels and of the first and second upper U-channels have respective bottom surfaces that are spaced apart a distance equal to the distance between the upper and lower pins of the guard fence member, so that the lower U-channels and the upper U-channels simultaneously support the lower and upper pins, respectively, of the guard fence member.

11. The apparatus of claim 10 wherein the length of the slots of the first and second lower U-channels are substantially longer than the length of the slots of the first and second upper U-channels, so that the upper pins of the guard fence member can be lifted out of the slots of the upper U-channels and the lower pins of the guard fence member remain within the slots of the lower U-channels.

12. The apparatus of claim 11 wherein:

a. each of the first and second upper U-channels is formed with first and second side legs and a middle leg, the middle leg defining the upper U-channel slot; and b. the first side leg of the upper U-channel is shorter than the second side leg to create a step in the top end of the upper U-channel.

13. The apparatus of claim 9 further comprising bolt means inserted through a selected one of the lower and upper U-channels for preventing the guard fence member pins from being lifted out of the slots of the lower and upper U-channels.

14. The apparatus of claim 12 further comprising bolt means removably inserted through the side leg of at least one of the upper U-channels for preventing the guard fence member pins from being lifted out of the lower and upper U-channels.

15. A method of assembling a guard fence system comprising the steps of:

a. mounting a pair of spaced upstanding posts to a selected member;

b. attaching a lower U-channel on each post, each lower U-channel having an open top end with a vertically oriented slot opening into the top end;

c. attaching an upper U-channel to each post, each upper U-channel having an open top end with a vertically oriented slot opening into the top end;

d. providing a guard fence member having oppositely extending upper and lower pins;

e. inserting the lower pins of the guard fence member into the slots of the lower U-channels on the posts;

f. pivoting the guard fence member until the upper pins thereof are vertically over the slots of the upper U-channels on the posts; and g. dropping the guard fence member such that the upper pins thereof enter the slots of the upper U-channels.

16. The method of claim 15 wherein the step of pivoting the guard fence member comprises the steps of:

a. pivoting the guard fence member until the upper pins thereon are proximate the upper U-channels on the posts; and b. lifting and further pivoting the guard fence member until the guard fence member upper pins are vertically over the slots of the upper U-channels on the posts.

17. The method of claim 15 further comprising the step of lifting the pins on the guard fence member out of the slots in the lower U-channel and in the upper U-channel to thereby disassemble the guard fence member from the posts.

18. The method of claim 15 further comprising the step of inserting a bolt through a selected one of the lower and upper U-channels to prevent lifting the guard fence member pins out of the lower U-channels and upper U-channels.

* * * * *